US012571613B2

(12) United States Patent
Haering

(10) Patent No.: US 12,571,613 B2
(45) Date of Patent: Mar. 10, 2026

(54) CLAMPING SYSTEM FOR ACCESSORIES ON A PICATINNY RAIL

(71) Applicant: Recknagel GmbH & Co. KG, Bergrheinfeld (DE)

(72) Inventor: Walter Haering, Dittelbrunn (DE)

(73) Assignee: RECKNAGEL GMBH & CO. KG, Bergrheinfeld (DE)

( * ) Notice: Subject to any disclaimer, the term of this patent is extended or adjusted under 35 U.S.C. 154(b) by 0 days.

(21) Appl. No.: 18/417,008

(22) Filed: Jan. 19, 2024

(65) Prior Publication Data

US 2024/0247914 A1 Jul. 25, 2024

(30) Foreign Application Priority Data

Jan. 25, 2023 (DE) ..... 202023000163.3

(51) Int. Cl.
*F41G 11/00* (2006.01)

(52) U.S. Cl.
CPC ..... *F41G 11/003* (2013.01)

(58) Field of Classification Search
CPC ..... F41G 11/001; F41G 11/003; F41G 11/004
USPC ..... 42/124, 127, 148
See application file for complete search history.

(56) References Cited

U.S. PATENT DOCUMENTS 3,324,558 A * 6/1967 Hart ..... F41G 11/007 42/127
6,606,813 B1 8/2003 Squire et al.
7,308,772 B1 * 12/2007 Millett ..... F41G 11/004 42/127
7,802,395 B1 * 9/2010 Swan ..... F41G 11/003 403/374.5
10,161,704 B1 * 12/2018 Lee ..... F41A 21/325
10,907,937 B1 * 2/2021 Keng ..... F41G 11/003
2008/0092421 A1 4/2008 Beckmann
2010/0031553 A1 * 2/2010 Couture ..... F41G 11/003 42/90
2011/0146128 A1 6/2011 Haering
2013/0312307 A1 11/2013 Rorick
2015/0316355 A1 * 11/2015 Boswell ..... F41G 11/004 42/146
2016/0216062 A1 * 7/2016 Trotabas ..... F41G 11/003
2017/0261288 A1 9/2017 Bartoszewicz
2022/0333900 A1 * 10/2022 Beasley ..... F41G 11/003

FOREIGN PATENT DOCUMENTS

DE 20313331 U1 * 11/2003 ..... F41G 11/004
DE 202011002180 U1 8/2011
EP 2339287 A2 6/2011
EP 3783294 B1 2/2021
WO 2005083351 A1 9/2005

* cited by examiner

*Primary Examiner* — Bret Hayes
(74) *Attorney, Agent, or Firm* — Abel Schillinger, LLP

(57) ABSTRACT

A clamping system for accessories on a Picatinny rail. The system can be moved by a horizontally pivotable lever from a released state into a state clamped on the Picatinny rail. In the state clamped on the Picatinny rail, a contact face of a movable clamping jaw with respect to the eccentric cam of the lever is located above the surface and within the width B of the Picatinny rail.

14 Claims, 10 Drawing Sheets

CLAMPING SYSTEM FOR ACCESSORIES ON A PICATINNY RAIL

CROSS-REFERENCE TO RELATED APPLICATIONS

The present application claims priority under 35 U.S.C. § 119 of German Utility Model Application No. 20/2023000163.3, filed Jan. 25, 2023, the entire disclosure of which is expressly incorporated by reference herein.

BACKGROUND OF THE INVENTION

1. Field of the Invention

The present invention relates to a clamping system for accessories on a Picatinny rail.

2. Discussion of Background Information

Self-loading rifles, such as, for example, assault rifles for military use, are often provided with accessories, such as telescopic sights, red dot sights, lamps, lasers, bipods, etc. For simple and repeatedly precise securing of these accessories, these weapons are generally provided on the upper side of their system with prism rails which are produced in accordance with MIL-STD-1913 or standards based on MIL-STD-1913. Prism rails of this construction type are referred to as "Picatinny rails" and comprise a profile which extends in a firing direction and which is provided at regular spacings with cross slots. The mounting systems for fitting accessories are provided on the side thereof facing the Picatinny rail with at least one recoil lug, which engages in one of the cross slots. The hand guard and other components of the weapon may also be provided with Picatinny rails, wherein the Picatinny rails either may be an integral part of a component of the weapon or take the form of separate components which, for example, can be connected by means of a screw connection to the corresponding weapon component.

A clamping system for accessories on Picatinny rails is disclosed, for example, in EP 2 339 287 A2, the entire disclosure of which is incorporated by reference herein. This mounting system has for clamping on the Picatinny rail either a nut system or a lever system. The lever system was configured in terms of its dimensions in such a manner that, as a result of the relatively great length of the lever, a very high clamping force can be applied and, as a result of its bent shape, the lever is relatively simple to operate, even with gloves. If, for example, telescopic sights are secured with such clamping systems, the adjustment turrets which are fitted to the left and right on the telescopic sight for parallax compensation, the illumination unit and the lateral adjustment protrude laterally further than the nut or lever system. The clamping system consequently does not disturb during use of the weapon. This mounting system is also very suitable for clamping night vision or thermal imaging attachments. These very wide and heavy accessories also protrude with the body thereof in most cases substantially beyond the clamping system. Another advantage of the lever system, also with respect to the nut system disclosed in the same application, is the tool-free operation thereof and the always-constant clamping torque.

A clamping system constructed in accordance with EP 2 339 287 A2 has a very wide construction since the lever protrudes laterally to a great extent beyond the width of the Picatinny rail. This is a result of the fact that the contact face of the movable clamping jaw with respect to the lever is arranged laterally beside the Picatinny rail. In addition, the rotation axis of the lever is located even further laterally offset in an outward direction beside the Picatinny rail than the contact face of the movable clamping jaw.

Widely used military self-loading weapons, such as, for example, weapons of the type AR15 and AR10, have on the housing upper side thereof a Picatinny rail and a charging handle which is located at the rear. The term "located at the rear" means that, although the operating elements of the charging handle protrude laterally beyond the width of the Picatinny rail, they are located behind the end of the Picatinny rail facing the shooter. Consequently, when the charging handle is activated, clamping systems which protrude laterally to a great extent do not disturb.

In order to be able to provide them with accessories, repeating rifles also often have Picatinny rails on the receiver thereof. Also in this instance, extensively laterally protruding clamping systems do not disturb when the operating elements of the clamping systems are located, when viewed in the firing direction, on the left, closed side of the receiver and the accessories have a correspondingly wide construction. On the right side, the receivers of repeating rifles generally have the ejection port for the cartridge cases. In this instance, very extensively protruding clamping systems may impede the ejection of the case. Therefore, the activation elements of the mounting systems on repeating rifles are in most cases mounted on the left side of the weapon.

The development of military self-loading weapons has recently produced weapon systems in which the charging handle is located laterally very close below the Picatinny rail and, when viewed in the firing direction, at the height of the target optics intended to be fitted thereon. Weapons of this type are, for example, the HK433 and the HK437 from Heckler & Koch, the CZ BREN from Česká zbrojovka a.s., and the FN-SCAR from Fabrique Nationale Herstal. During the activation of the charging handle, injuries may occur if the shooter's hand gets caught on the operating elements of the clamping system for the target optics.

Red dot sights with 1× magnification and a closed housing are often used as target optics for various weapon types. In many devices of this construction type, the housing for the battery or the rotary control for the various illumination stages are located laterally on the optics housing. The rotary control or the housing for the battery often form a unit. The development in recent times involves the optics housings being very narrow and managing without any laterally protruding components. An example of this construction type is, for example, the ACRO from the company Aimpoint. In order to prevent catching on the clothing of the shooter and to improve the handling of the entire system comprising the weapon and target optics, a very narrow clamping system affords significant advantages.

There is consequently the requirement for a clamping system for accessories on Picatinny rails, in particular for fitting red dot sights with 1× magnification, which has a very small lateral overhang beyond the width of the Picatinny rail and which can be operated in a tool-free manner. In order to increase the application area of such a clamping system, the clamping force thereof must be great enough for it to be able to be used universally on all weapon types. At the same time, it should be able to be operated simply and safely with gloves. In order to be able to cover the sight lines at different levels of the most common weapon types, it should be able to be constructed at various heights.

In order to enable tool-free operation, clamping systems which are operated by means of nuts or screws cannot be considered. The advantage of such clamping systems is the great clamping force which can be applied by means of the operating wrench. Such clamping systems are consequently also suitable for use, for example, on heavy machine guns.

In the prior art, in addition to EP 2 339 287 A2 different clamping systems for accessories on Picatinny rails are already known:

DE 20 2011 002 180 U1, the entire disclosure of which is incorporated by reference herein, discloses a clamping system which can be activated in a tool-free manner by means of clamping levers. The levers bear very closely up against the body of the mounting apparatus but are configured to be very short, whereby the clamping force which is produced is quite small.

U.S. Pat. No. 6,606,813 B1, the entire disclosure of which is incorporated by reference herein, shows a clamping system which is particularly low and which can be operated in a tool-free manner by means of a clamping lever. In FIG. 10, it can be seen that the pivot axis of the lever is significantly further from the center of the Picatinny rail than the outer face of the movable clamping jaw, whereby the lever laterally overhangs to a relatively great extent.

US 2013/0312307 A1, the entire disclosure of which is incorporated by reference herein, shows a clamping system which has a relatively small lateral overhang. A spring directs a tensile force into a wedge-like component, which in turn directs the clamping force into the movable clamping jaw. In order to unlock the clamping system, by means of a push-button the wedge-like component is moved counter to the spring force. A disadvantage of this system is the relatively small clamping force which is applied by the spring and the wedge-like component.

US 2010/0107467 A1, the entire disclosure of which is incorporated by reference herein, discloses a clamping system which can be activated in a tool-free manner by means of levers. In FIG. 2 and FIG. 5, it can be seen that the vertically arranged rotation axes of the levers are located significantly further away from the center of the Picatinny rail than the outer faces of the clamping jaws, which results in a relatively great lateral overhang of the clamping levers.

US 2017/0261288 A1, the entire disclosure of which is incorporated by reference herein, discloses a clamping system which has a very small lateral overhang and which can be operated in a tool-free manner. The clamping is carried out by means of a screw-like component, the head of which has on the circumference projections and recesses. These projections and recesses serve, on the one hand, for securing in the clamped state (see FIG. 10 and FIG. 24); on the other hand, they provide the required grip in order to be able to operate the component manually. The torque which is applied to the screw-like component only manually and, as a result the transmitted clamping force to the Picatinny rail, are relatively small.

WO 2005/083351 A1, the entire disclosure of which is incorporated by reference herein, shows a clamping system which can be operated in a tool-free manner by means of a horizontally pivotable lever. In FIG. 2 and FIG. 3, it can be seen that the vertically arranged pivot axis is significantly further away from the center of the Picatinny rail than the outer face of the movable clamping jaw. This arrangement results in the mounting apparatus laterally overhanging to a relatively great extent. In FIG. 1, it can be seen that the lever in the closed position thereof is fully integrated in the housing, but only because the outer wall of the housing has been pulled out to a corresponding extent beyond the outer face of the movable clamping jaw.

EP 3 783 294 B1, the entire disclosure of which is incorporated by reference herein, discloses a clamping system in which the pivot axis of the lever is arranged horizontally. In order to apply the clamping force, the lever must be pivoted upward and bears there on the housing, which results in a relatively great minimum structural height of the housing. Also in this instance, the pivot axis of the lever is located further away from the center of the Picatinny rail than the outer face of the movable clamping jaw, which results in a relatively great lateral overhang.

In view of the foregoing, it would be advantageous to have available a clamping system for accessories on Picatinny rails which has the smallest possible lateral overhang beyond the Picatinny rail and can be operated in a tool-free manner. The clamping force should be so great that it can be used without hesitation on all weapon types and it should be able to be constructed at different heights.

SUMMARY OF THE INVENTION

The present invention provides a clamping system for accessories on a Picatinny rail as set forth in the claims below.

The clamping apparatus according to the invention has for the operation thereof a horizontally pivotable lever having an eccentric cam and a movable clamping jaw, wherein the contact face of the movable clamping jaw with respect to the eccentric cam on the lever is located above the surface and within the width of the Picatinny rail. This enables a significantly slimmer construction of the mounting apparatus since the contact face has been relocated from the outer side of the movable clamping jaw in the direction of the center of the Picatinny rail.

As a result of the relocated position of the contact face in the direction of the center of the Picatinny rail, the lever in the closed state can be completely integrated in the slim housing.

In a particularly preferred embodiment, the lever is provided with a securing detent and protrudes as a result of its relatively great length in the locked state at least with the securing detent beyond the front or rear end of the housing. Consequently, the lever can be operated even with gloves in a simple and safe manner and, as a result of its length, a relatively great clamping force is produced.

The vertical arrangement of the pivot axis of the lever enables a relatively low structural height of the housing since, as a result of this arrangement, the clamping lever can be pivoted in a horizontal direction and does not have to be folded upward onto the housing.

The invention is explained below by way of example with reference to the Figures.

In the embodiment shown in the Figures, the housing has only one clamping system according to the invention. In other embodiments of the invention which are not illustrated in the Figures, a plurality of clamping systems may be installed at the same time in a housing.

DETAILED DESCRIPTION OF EXEMPLARY EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

Figure 1:
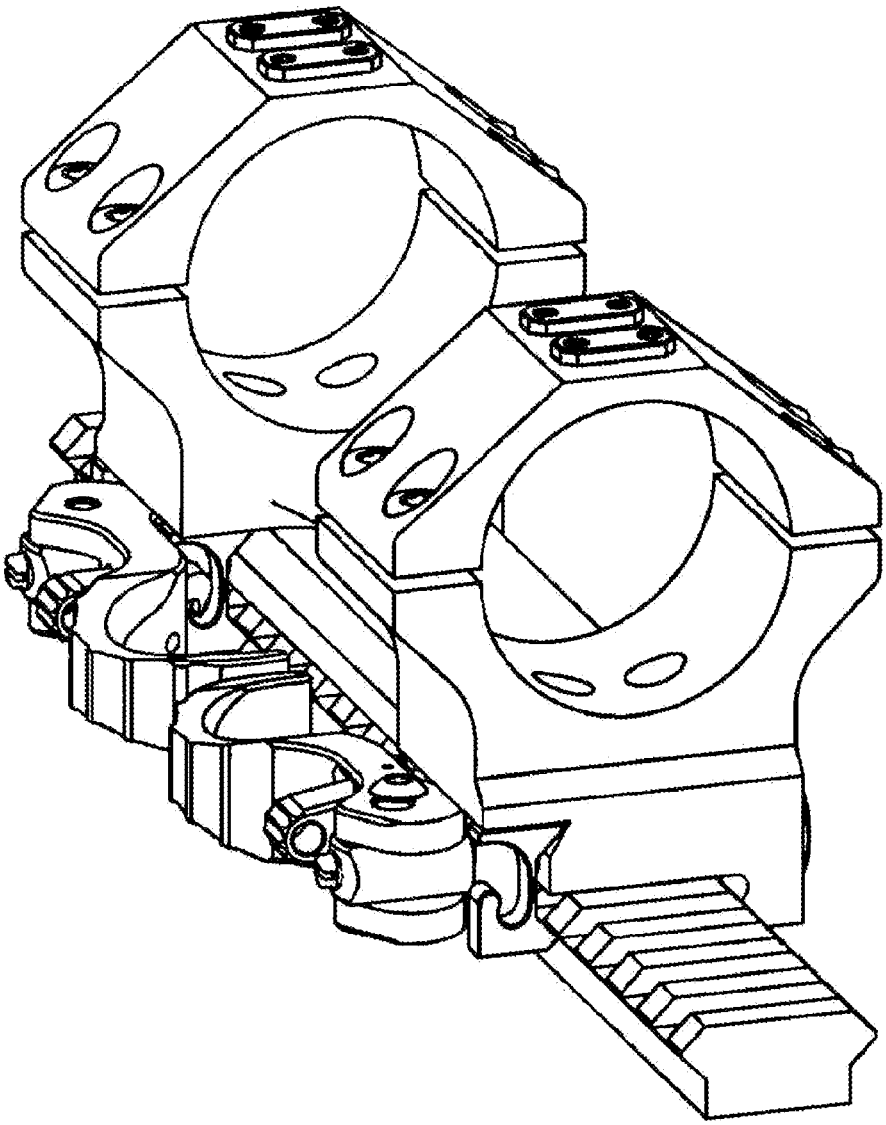
Fig. 1 Prior art
FIG. 1 shows a clamping system according to EP 2 339 287 A2, corresponding to the prior art, in a perspective illustration.

FIG. 1 shows a clamping system according to EP 2 339 287 A2, corresponding to the prior art. The clamping system is illustrated in the state clamped on a Picatinny rail. It can be seen that the lever laterally protrudes to a very great extent beyond the Picatinny rail since the contact face of the movable clamping jaw with respect to the eccentric of the lever is arranged laterally beside the Picatinny rail. In addition, the rotation axis of the lever is located so as to be offset even further laterally outwardly beside the Picatinny rail than the contact face of the movable clamping jaw with respect to the eccentric of the lever. As a result of the construction type, the contact face of the movable clamping jaw is formed by the outer face thereof.

Figure 2:
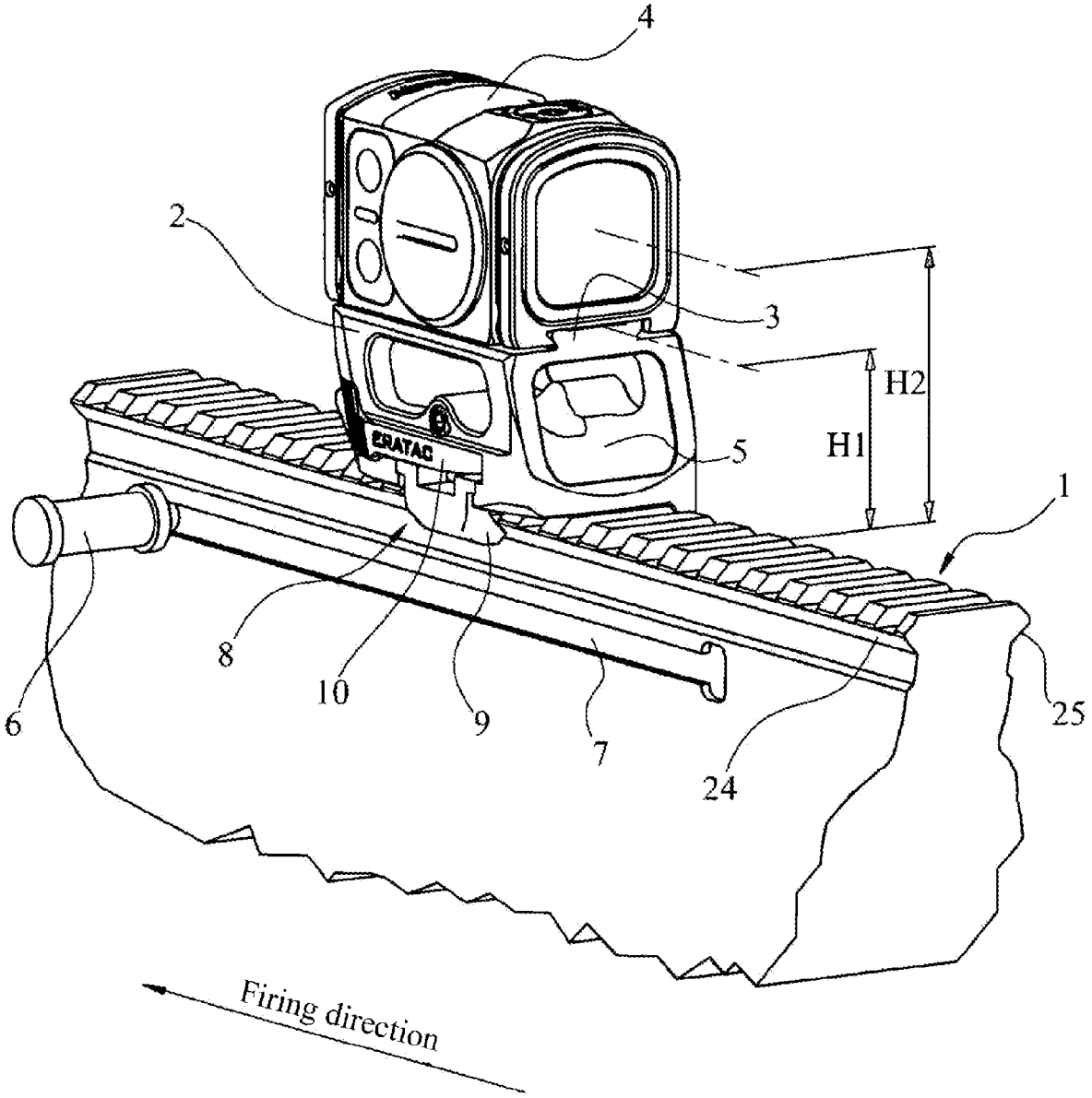
FIG. 2 shows a clamping system in the clamped state and installed in a housing, having an accessory which is mounted on the housing and clamped on the Picatinny rail of an assault rifle, in a perspective illustration.

FIG. 2 shows a clamping system according to the invention for accessories in the state clamped on a Picatinny rail 1. The clamping system is installed in a housing 2, the upper side of which is provided with an interface 3 for receiving an accessory 4. In this exemplary embodiment, the interface 3 is by way of example designed for receiving the ACRO red dot sight with 1× magnification from the company Aimpoint. The interface 3 may be designed for any type of accessory, such as, for example, red dot sights, telescopic sights, optical magnifiers, lasers, lamps, rangefinders, etcetera. The housing 2 is clamped on the Picatinny rail 1 by means of the clamping system according to the invention.

The height H1 of the housing 2 determines the height H2 of the optical axis of the accessory 4. Both dimensions are measured from the surface of the Picatinny rail 1 on which the housing 2 rests with the base face 50 thereof (see FIG. 3) in the clamped state of the clamping system. Different weapon types require different heights for the various accessories. If, for example, a lamp or a laser is intended to be secured with the clamping system according to the invention, it is advisable to select the technically lowest possible height H1. If, for example, a red dot sight is intended to be secured on a repeating rifle, the height H1 is intended to be selected to be lower than when securing the same red dot sight on an assault rifle. When fitting target devices, the height H1 is highly dependent on the height of the cheek rest of the buttstock or the stock of the weapon. The passage 5 in the housing 2 serves for saving weight. If the housing 2 is intended to be constructed with a greater height H1 than shown in FIG. 1, the height of the passage 5 increases. If the housing 2 is intended to be constructed with the lowest possible height H1 thereof, the passage 5 can be dispensed with.

FIG. 2 shows the charging handle 6 in the front end position thereof. In order to charge the weapon, the charging handle 6 must be pulled by hand in the groove 7 into the rear end position thereof. With extensively overhanging clamping systems, injuries to the hand may occur during this movement sequence.

In order to avoid injuries, the housing 2 has a very narrow construction. From the clamping system according to the invention which is installed therein, no components protrude laterally beyond the housing 2. The housing 2 has at the front and rear beveled portions and the movable clamping jaw 8 has rounded portions on the claw 9 thereof. In the closed state, the lever 10 is completely integrated in the housing 2.

Figure 3:
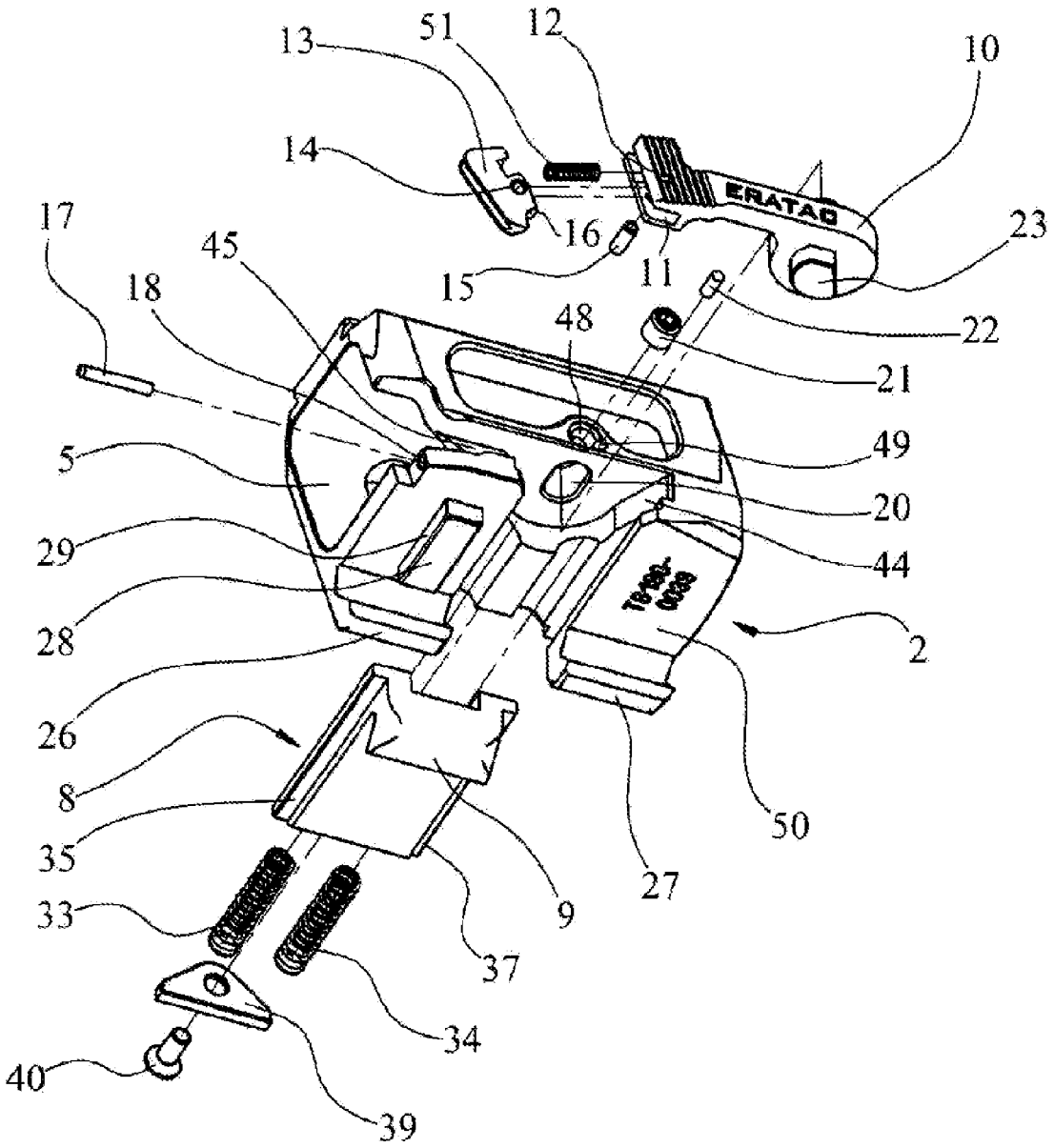
FIG. 3 shows a clamping system in the clamped state, installed in a housing, in an exploded view.

FIG. 3 shows the lever 10 with the groove 11 and the hole 12 which extends transversely therein. A securing element in the form of a lever pawl 13 has a hole 14. Using the clamping sleeve 15, the lever pawl 13 is rotatably supported in the lever 10. The pressure spring 51 presses the lever pawl 13 with the stop face 16 thereof against the base of the groove 11.

The securing pin 17 is fixed in the hole 18 in the housing 2 by means of adhesive bonding or pressing in and serves for securing the lever 10 against undesirable opening.

The rotary pin 19 (see FIG. 6) of the lever 10 is mounted rotatably in the elongate hole 20 of the base member 2 and displaceably transversely with respect to the firing direction.

Using the adjustment screw 21, the position of the lever 10 transversely relative to the Picatinny rail 1 can be adjusted. Consequently, production tolerances on the prism of the Picatinny rail 1 and in the clamping system can be compensated for and the desired clamping force can be adjusted. The plastics material pin 22 is inserted in the blind hole bore 49 which extends axially parallel with respect to the inner thread 48 and which protrudes partially into the inner thread 48. Consequently, the thread flanks of the adjustment screw 21 deform the plastics material pin 22, which secures the adjustment screw 21 against undesirable rotation.

In the clamped state, the claw 9 of the movable clamping jaw 8 is pulled by the eccentric cam 23 of the lever 10 against the first lower flank 24 of the Picatinny rail 1 (see also FIG. 2). The housing 2 is supported with the first fixed jaw 26 and the second fixed jaw 27 thereof on the opposing second lower flank 25 of the Picatinny rail 1 and the base member 2 is pulled onto the surface of the Picatinny rail 1.

The stop 28 on the housing 2 serves for receiving the recoil forces. It engages in the clamped state in one of the cross slots of the Picatinny rail 1 and bears with the front stop face 29 thereof on the rear wall of the corresponding transverse groove.

Figure 4:
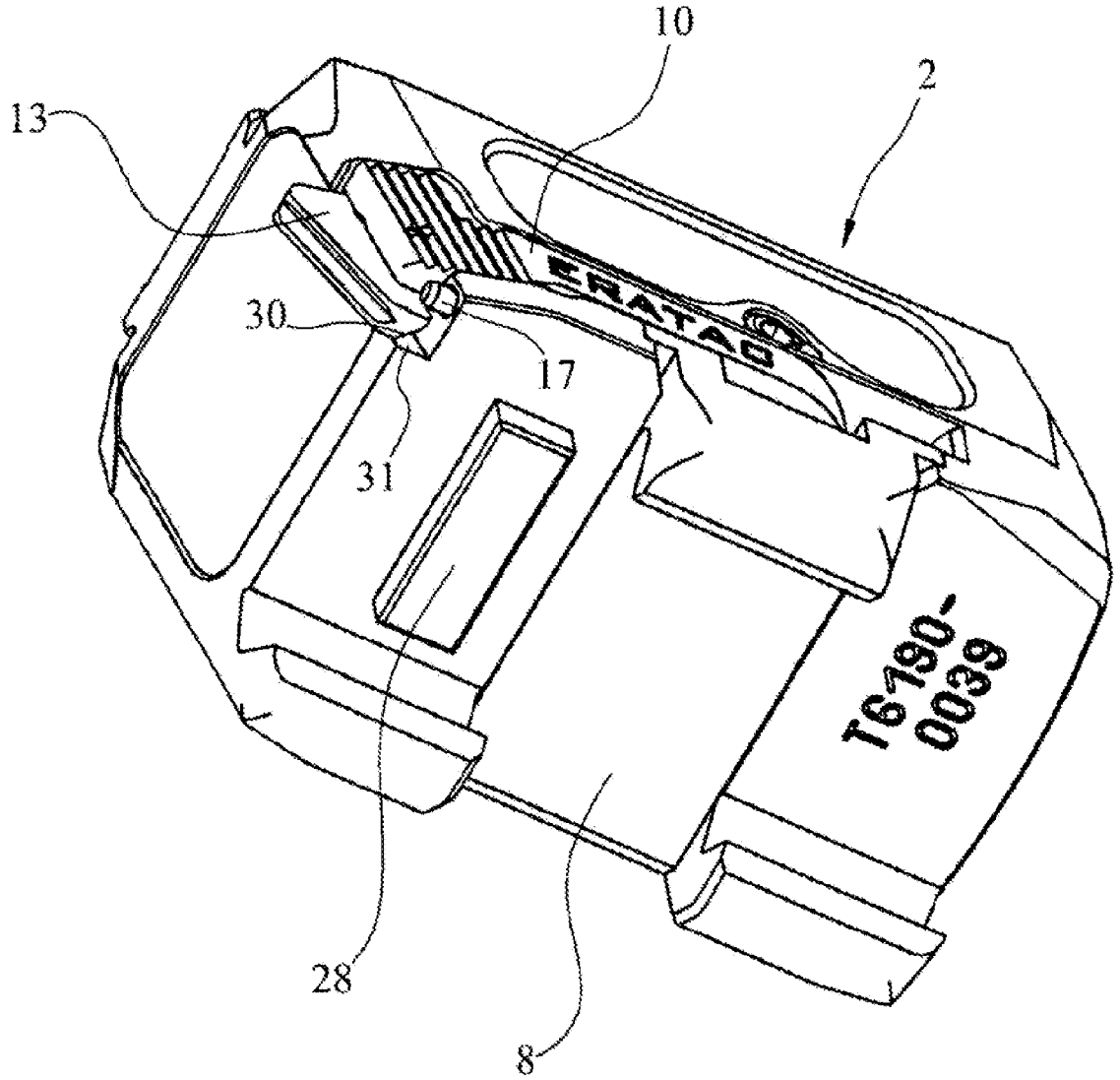
FIG. 4 shows a clamping system in the clamped state, installed in a housing, in a perspective illustration when viewed obliquely from below.

In FIG. 4, the run-on slope 30 on the lever pawl 13 can be seen. If the clamping system is moved into the clamped position by pivoting the lever 10, the lever pawl 13 slides along the run-on slope 30 beyond the securing pin 17. The pressure spring 51, see FIG. 3, is compressed in this instance. As soon as the securing pin 17 has been passed, the lever pawl 13 engages in the undercut between the securing pin 17 and the securing face 31 on the housing 2.

Figure 5:
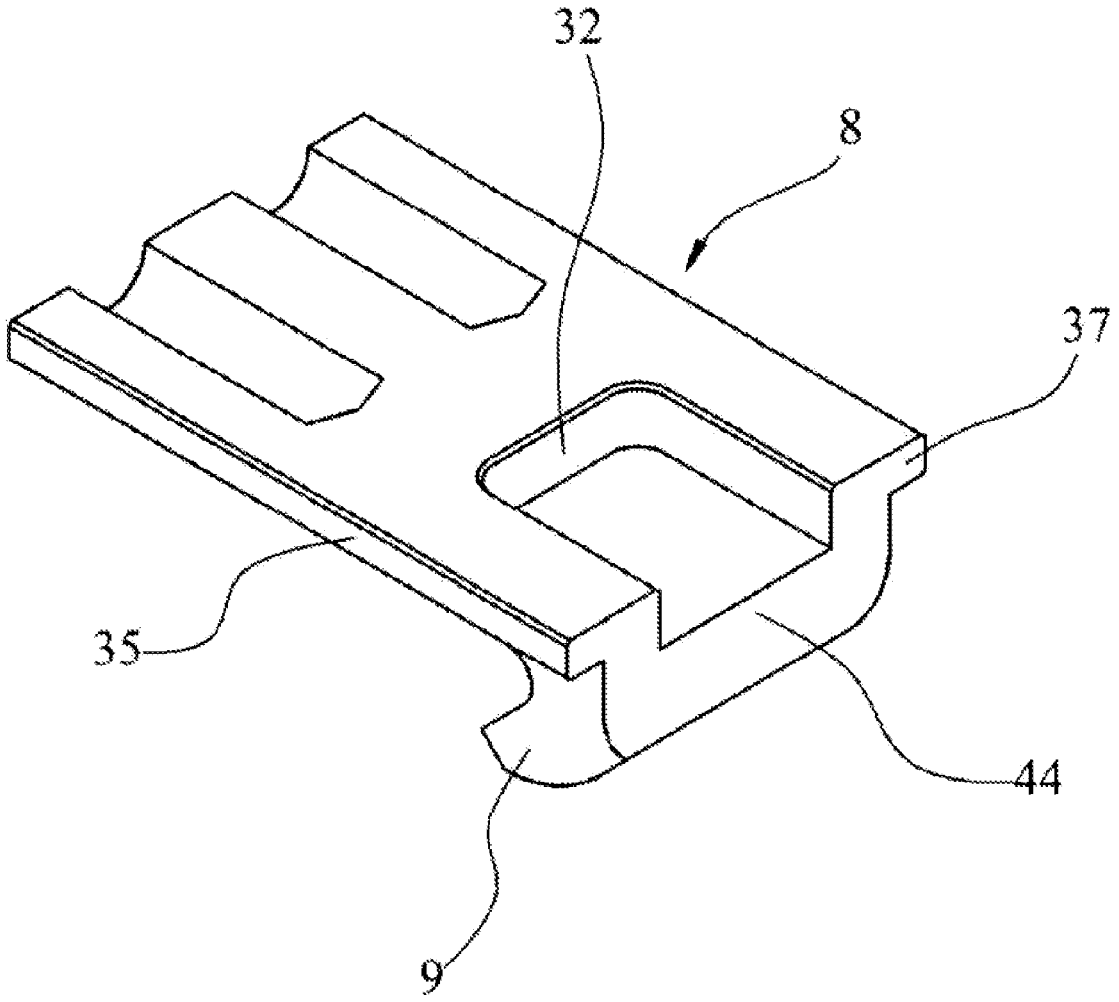
FIG. 5 shows a movable clamping jaw in a perspective illustration.

In FIG. 5, the movable clamping jaw 8 with the contact face 32 thereof can be seen. The eccentric cam 23 (see FIG. 3) on the lever 10 rolls on the contact face 32 when it is activated. The first pressure spring 33 and the second pressure spring 34, see FIG. 3, ensure constant contact of the face 32 with respect to the eccentric cam 23 over the entire pivot range of the lever 10. The movable clamping jaw 8 is displaceably mounted in the housing 2 by the first continuation 35 in the first guiding groove 36 (see FIG. 10) and by the second continuation 37 in the second guiding groove 38 (see FIG. 10). The metal support sheet 39, see FIG. 3, is screwed by means of the countersunk screw 40 in the housing 2 and supports the two pressure springs 33 and 34.

Figure 6:
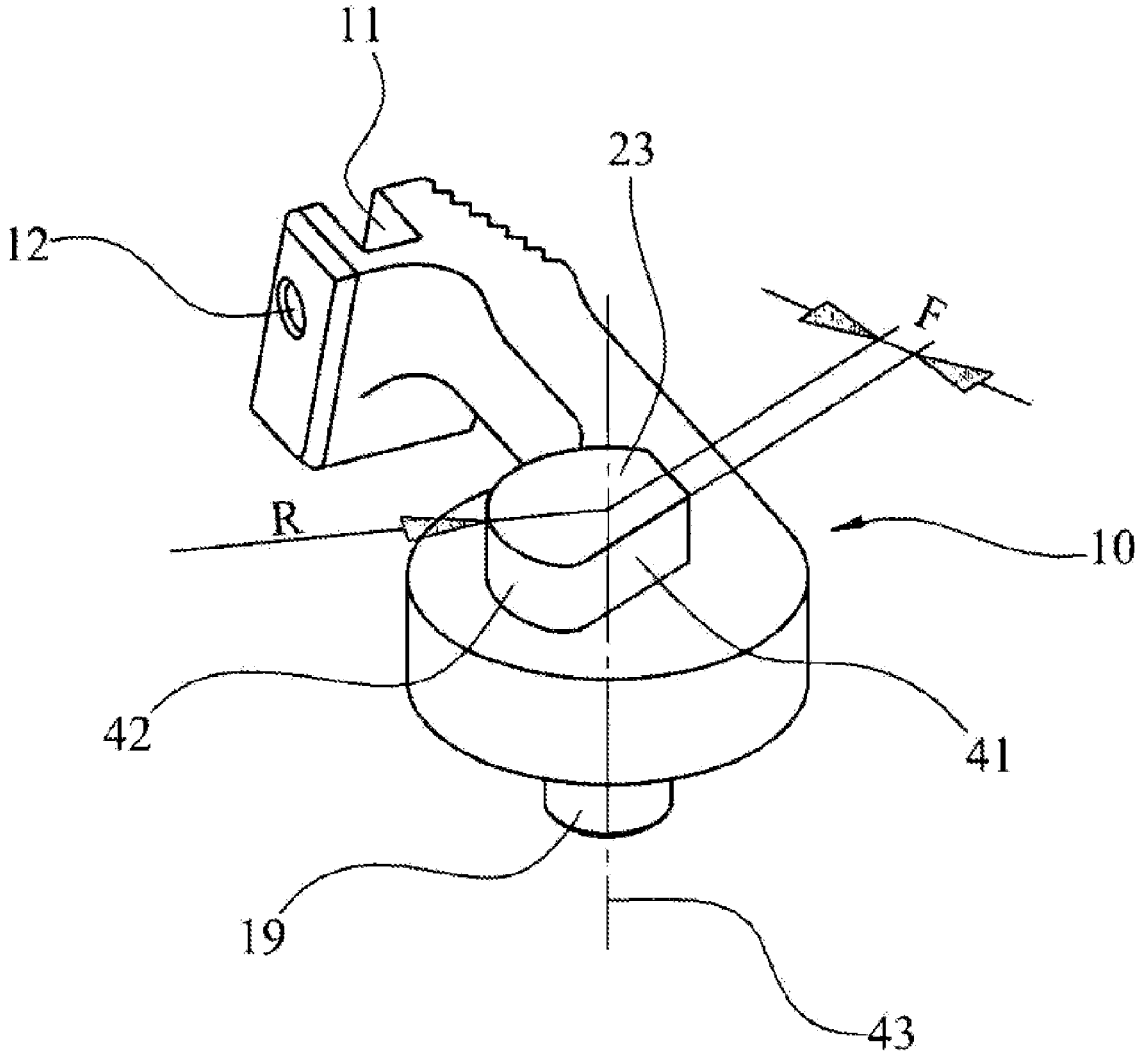
FIG. 6 shows the lever in a perspective illustration.

FIG. 6 shows the lever 10 with the eccentric cam 23 on which the free face 41 is located with the distance F thereof relative to the rotation axis 43 of the lever 10 and the radius face 42 is located with the radius R thereof about the rotation axis 43 of the lever 10. The radius R is greater than the distance F, wherein the difference between the two dimensions has been selected to be so great that the claw 9 of the movable clamping jaw 8 releases the Picatinny rail 1 in the open state of the clamping system and the mounting apparatus can be removed.

Figure 7:
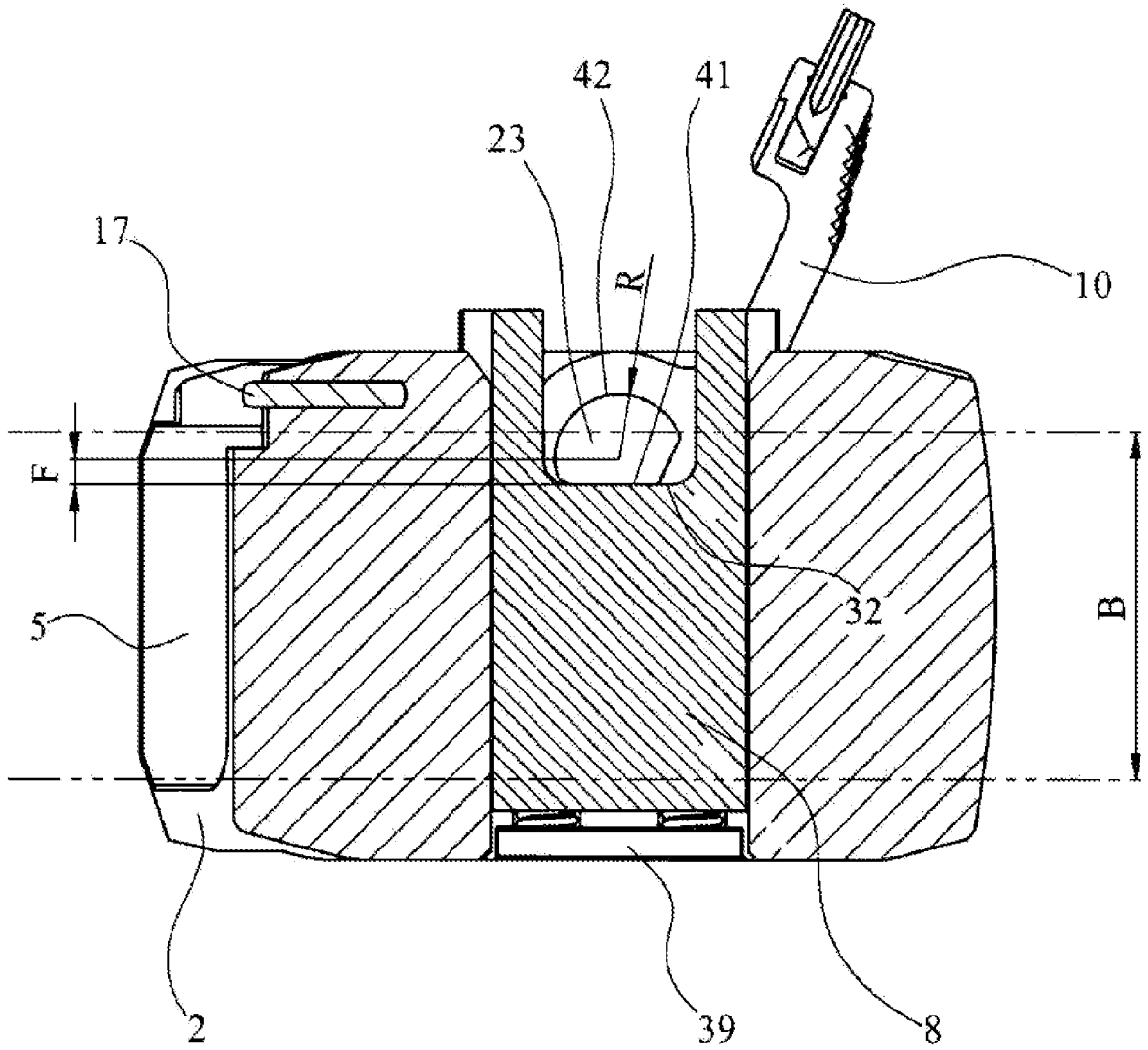
FIG. 7 shows a clamping system in the released state, installed in a housing, when viewed from below in section.

In FIG. 7, it can be seen that the eccentric cam 23 in the released state of the clamping system bears with the free face 41 thereof on the contact face 32. The path when opening the lever 10 is limited by the first stop face 44 (see FIG. 3) in the housing 2.

Figure 8:
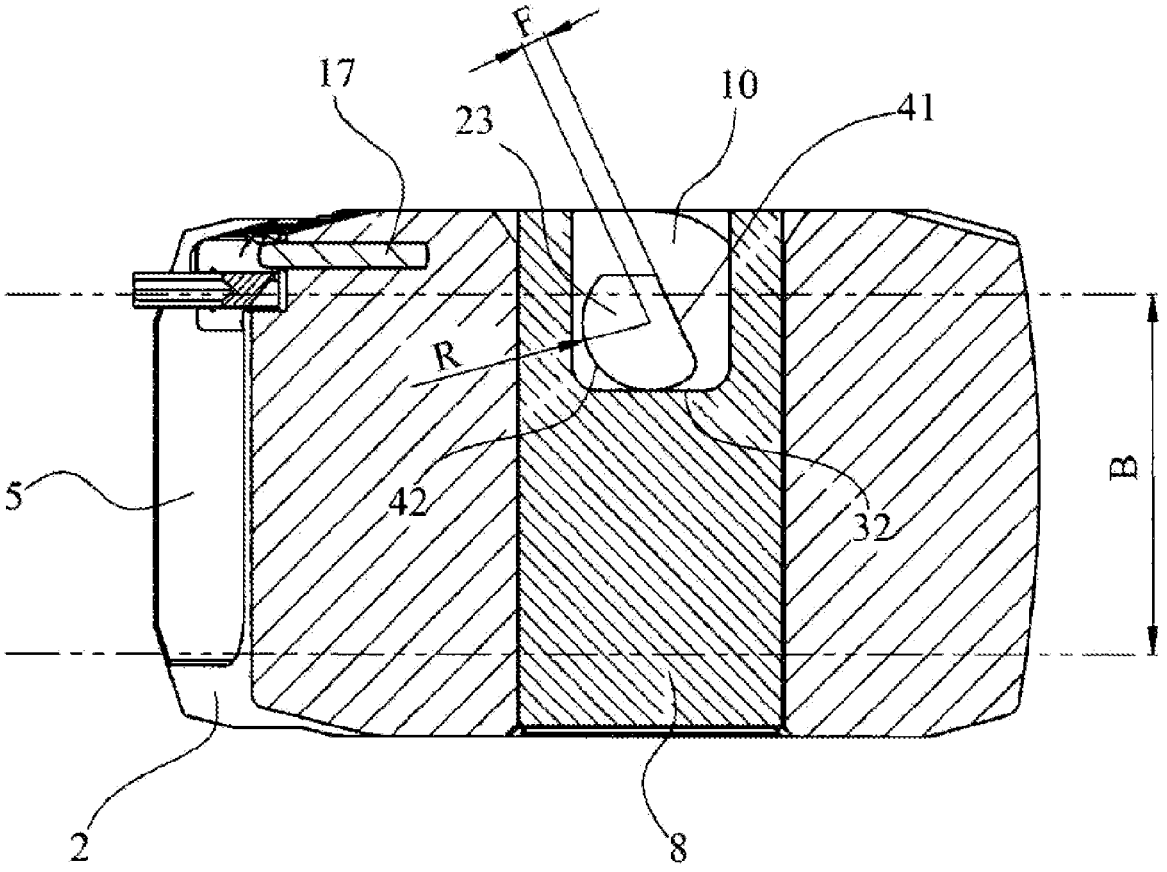
FIG. 8 shows a clamping system in the clamped state, installed in a housing, when viewed from below in section.

In FIG. 8, it can be seen that the eccentric cam 23 in the clamped state of the clamping system bears with the radius face 42 thereof on the contact face 32. The path when closing the lever 10 is limited by the second stop face 45 (see FIG. 3) in the housing 2.

Figure 9:
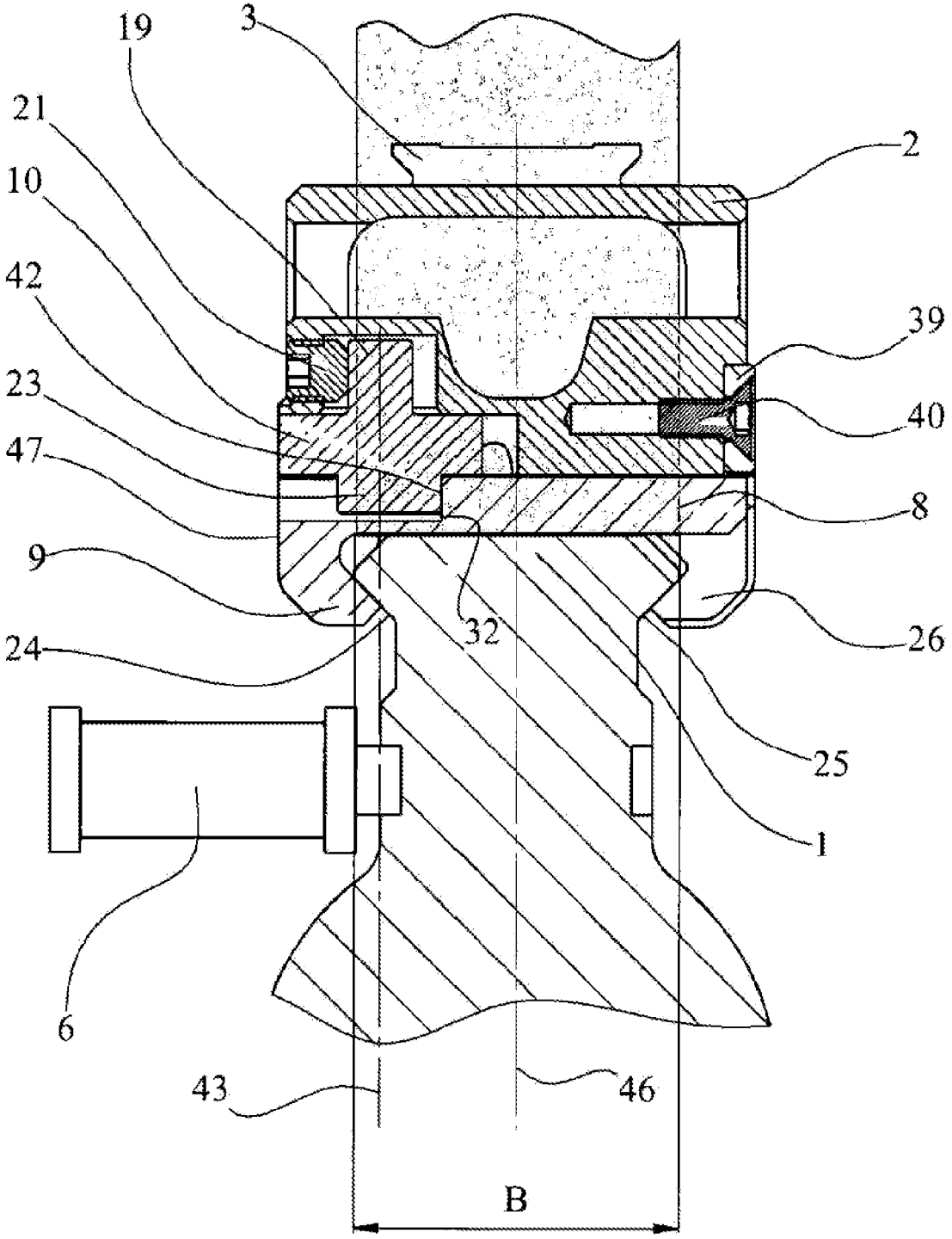
FIG. 9 shows a clamping system in the clamped state, installed in a housing and clamped on the Picatinny rail of an assault rifle, when viewed from the rear in section.

FIG. 9 illustrates that, in the state clamped on the Picatinny rail 1, the contact face 32 of the movable clamping jaw 8 with respect to the eccentric cam 23 of the pivot lever 10 is located above the surface and within the width B of the Picatinny rail 1. The adjustment screw 23 presses in this instance against the rotary pin 19, whereby the eccentric cam 23 is pressed with the radius face 42 against the contact face 32 of the movable clamping jaw 8. In addition, it can be seen that the rotation axis 43 of the lever 10 is closer to the center 46 of the Picatinny rail 1 than the outer face 47 of the movable clamping jaw 8. In the clamping systems shown in the prior art, which are activated with levers, the contact between the lever and movable clamping jaw is always carried out on an outer face of the clamping jaw. In the clamping system according to the invention, this contact face has been relocated to above the surface and within the width B of the Picatinny rail 1, whereby a substantially narrower construction of the overall system could be achieved. In addition, it can be seen that the rotation axis 43 of the lever 10 is located within the width B of the Picatinny rail 1, which also contributes to a significantly narrower construction of the overall system. The upwardly open field with a gray background in FIG. 9 defines the region in which the contact face 32 is located in a clamping system according to the invention. If, as in the illustrated embodiment of the invention, the rotation axis 43 of the lever 10 also extends through this field, it is located closer to the center 46 of the Picatinny rail 1 than the outer face 47 of the movable clamping jaw 8, which also contributes to a smaller lateral overhang.

Figure 10:
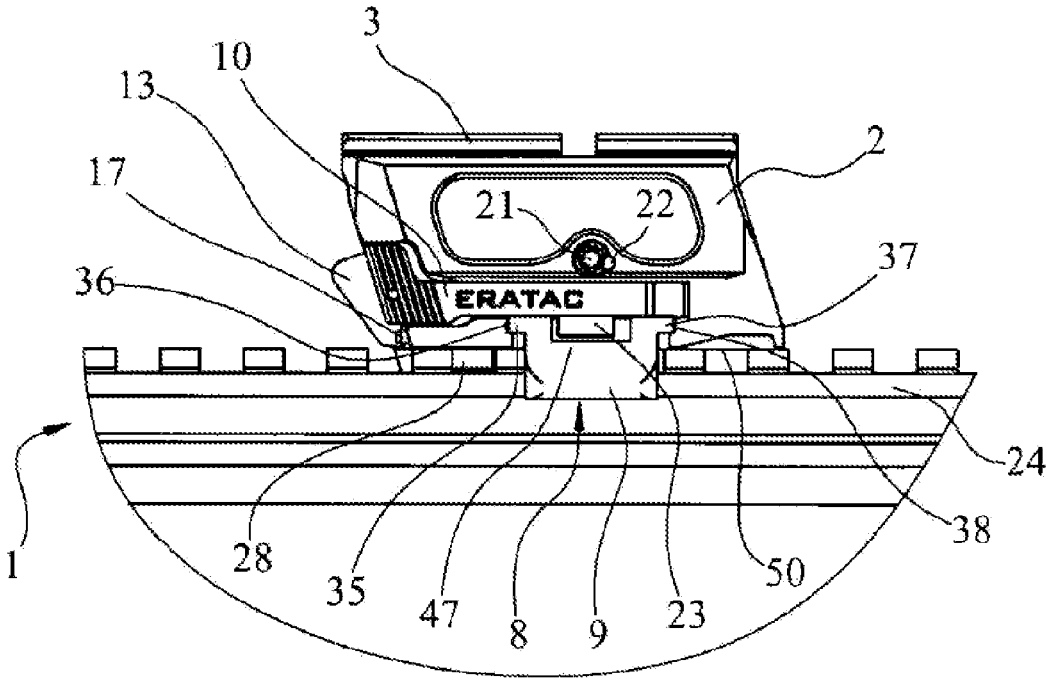
FIG. 10 shows a clamping system in the clamped state, installed in a housing and clamped on the Picatinny rail of an assault rifle, when viewed from the left side.

In FIG. 10, it can be seen that at least the lever pawl 13 protrudes beyond the front end of the housing 2. The lever 2 can thereby be moved in a simpler manner from the clamped position into the released position by the operator activating the lever pawl 13 with a finger, holding it in a pressed state and using it to pull the lever 10 at the same time. Depending on the configuration of the clamping system and the housing 2, it is conceivable for the lever 10 itself also to protrude partially beyond the front end of the housing 2.

In FIG. 2, the lever 10 is shown on the left side of the housing 2 and facing forward in the firing direction. In the other embodiments of the invention not shown in FIG. 2 to FIG. 10, the lever 10 may be configured on the right side of the housing 2 and/or facing backward in the firing direction. Depending on the embodiment of the interface 3, the housing 2 may be placed on the Picatinny rail 1 while rotated through 180°.

In another embodiment not shown in FIG. 2 to FIG. 10, the lever pawl 13 is mounted so as to be non-rotatable, but configured so as to be displaceable with respect to the lever 10 counter to a spring force.

In another embodiment not shown in FIG. 2 to FIG. 10, the spring which is installed between the lever 10 and the rotatably mounted lever pawl 13 is configured as a leg spring.

In another embodiment not shown in FIG. 2 to FIG. 10, the undercut in which the lever pawl 13 engages in the state clamped on the Picatinny rail 1, is formed, for example, by means of a correspondingly made groove in the housing 2.

In another embodiment not shown in FIG. 2 to FIG. 10, the clamping system is for cost reasons constructed in a simpler manner, that is to say without a lever pawl 13 for preventing undesirable opening of the lever 10. In this embodiment, the lever 10 itself protrudes partially beyond the front or rear end of the housing 2.

LIST OF REFERENCE NUMERALS

1 Picatinny rail
2 Housing
3 Interface
4 Accessory
5 Passage
6 Charging handle
7 Groove for charging handle
8 Movable clamping jaw
9 Claw of the movable clamping jaw
10 Lever
11 Groove in the lever
12 Hole in the lever
13 Lever pawl
14 Hole in the lever pawl
15 Clamping sleeve
16 Stop face on the lever pawl
17 Securing pin
18 Hole for the securing pin
19 Rotary pin
20 Elongate hole
21 Adjustment screw
22 Plastics material pin
23 Eccentric cam
24 First lower flank of the Picatinny rail
25 Second lower flank of the Picatinny rail

26 First fixed jaw
27 Second fixed jaw
28 Stop
29 Front stop face
30 Run-on slope
31 Securing face
32 Contact face
33 First pressure spring
34 Second pressure spring
35 First continuation
36 First guiding groove
37 Second continuation
38 Second guiding groove
39 Metal support sheet
40 Countersunk screw
41 Free face
42 Radius face
43 Rotation axis of the lever
44 First stop face in the housing
45 Second stop face in the housing
46 Center of the Picatinny rail
47 Outer face of the movable clamping jaw
48 Inner thread
49 Blind hole bore
50 Base face
51 Pressure spring

What is claimed is:

1. A clamping system for accessories on a Picatinny rail, wherein the system can be moved by a horizontally pivotable lever from a released state into a state clamped on the Picatinny rail, wherein, in the state clamped on the Picatinny rail, a contact face of a movable clamping jaw with respect to an eccentric cam of the lever is located above a surface and within a width (B) of the Picatinny rail, and wherein the lever has on an upper side thereof a rotary pin and on a lower side thereof the eccentric cam.

2. The clamping system of claim 1, wherein a rotation axis of the lever is located closer to a center of the Picatinny rail than an outer face of the movable clamping jaw.

3. The clamping system of claim 2, wherein the rotation axis of the lever is located within the width (B) of the Picatinny rail.

4. The clamping system of claim 1, wherein the system comprises a housing which has an elongate hole in which the rotary pin of the lever is mounted rotatably and displaceably transversely relative to the Picatinny rail.

5. The clamping system of claim 4, wherein the housing has an inner thread, which extends transversely relative to the Picatinny rail and comprises an adjustment screw which is screwed therein, and a blind hole bore having a plastics material pin located therein, wherein the inner thread and the blind hole bore extend axially parallel with respect to each other.

6. The clamping system of claim 5, wherein the blind hole bore protrudes partially into the inner thread and the thread flanks of the adjustment screw deform the plastics material pin.

7. The clamping system of claim 5, wherein a position of the lever transversely relative to the Picatinny rail can be adjusted by the adjustment screw screwed in the inner thread.

8. The clamping system of claim 1, wherein the eccentric cam of the lever in the released state of the clamping system presses with a free face against the contact face on a movable clamping jaw, and wherein the eccentric cam of the lever in the state clamped on the Picatinny rail presses with a radius face against the contact face on the movable clamping jaw, a radius (R) of a radius face about the rotation axis of the lever being greater than a distance (F) of the free face with respect to the rotation axis of the lever.

9. The clamping system of claim 8, wherein a difference between the radius (R) and the distance (F) is so great that a claw of the movable clamping jaw releases the Picatinny rail in an open state of the clamping system and the housing with the clamping system can be removed, and wherein, in a state clamped on the Picatinny rail, the claw of the movable clamping jaw bears on a first lower flank and a first fixed jaw and a second fixed jaw bear on a second lower flank and a base face of the housing rests on a surface of the Picatinny rail.

10. The clamping system of claim 1, wherein the clamping system comprises a housing which has on a base face thereof a stop which, in a state clamped on the Picatinny rail, engages in one of several cross slots of the Picatinny rail.

11. The clamping system of claim 1, wherein there is rotatably or displaceably secured on the lever a lever pawl which, in a state clamped on the Picatinny rail, engages in an undercut on a housing of the system as a result of a force of a spring.

12. The clamping system of claim 11, wherein the lever pawl protrudes beyond a front or rear end of the housing.

13. The clamping system of claim 1, wherein the lever protrudes beyond a front or rear end of a housing comprised in the system.

14. A clamping system for accessories on a Picatinny rail, wherein the system can be moved by a horizontally pivotable lever from a released state into a state clamped on the Picatinny rail, wherein, in the state clamped on the Picatinny rail, a contact face of a movable clamping jaw with respect to an eccentric cam of the lever is located above a surface and within a width (B) of the Picatinny rail, and wherein there is rotatably or displaceably secured on the lever a lever pawl which, in a state clamped on the Picatinny rail, engages in an undercut on a housing of the system as a result of a force of a spring, the lever pawl protruding beyond a front or rear end of the housing.

* * * * *